US005720243A

United States Patent [19]

Stegemyr et al.

[11] Patent Number: 5,720,243

[45] Date of Patent: Feb. 24, 1998

[54] DEVICE FOR SEPARATION OF DUST

[75] Inventors: Erik Stegemyr, Jönköping; Staffan Björklund, Arvika, both of Sweden

[73] Assignee: Aktiebolaget Electrolux, Stockholm, Sweden

[21] Appl. No.: 771,798

[22] Filed: Dec. 20, 1996

[30] Foreign Application Priority Data

Jan. 12, 1996 [SE] Sweden ..... 9600111

[51] Int. Cl.[6] ..... F02B 77/00

[52] U.S. Cl. ..... 123/198 E; 55/438; 55/DIG. 14; 55/DIG. 28

[58] Field of Search ..... 123/198 E, 41.7, 123/41.65; 55/DIG. 14, DIG. 28, 438, 471, 437

[56] References Cited

U.S. PATENT DOCUMENTS

| | | | |
|---|---|---|---|
| Re. 23,146 | 9/1949 | Packwood . | |
| 1,712,091 | 5/1929 | Pence . | |
| 2,585,083 | 2/1952 | Bouvy . | |
| 2,687,782 | 8/1954 | Sonderegger . | |
| 3,183,899 | 5/1965 | Tuggle . | |
| 3,252,449 | 5/1966 | Couchman, Jr. et al. . | |
| 3,426,513 | 2/1969 | Bauer . | |
| 3,581,717 | 6/1971 | Fullerton . | |
| 3,855,976 | 12/1974 | Notaras et al. . | |
| 3,994,067 | 11/1976 | Hazzard et al. . | |
| 4,233,043 | 11/1980 | Catterson . | |
| 4,261,302 | 4/1981 | Sheldon . | |
| 4,276,067 | 6/1981 | Lindman . | |
| 4,381,930 | 5/1983 | Hansen . | |
| 4,438,733 | 3/1984 | Sasaki . | |
| 4,537,160 | 8/1985 | Shirai . | |
| 4,716,860 | 1/1988 | Henriksson et al. . | |
| 4,791,860 | 12/1988 | Verheijen . | |
| 4,841,920 | 6/1989 | Andreasson et al. . | |
| 4,946,482 | 8/1990 | Tamba et al. . | |
| 5,083,538 | 1/1992 | Hubbell . | |
| 5,121,715 | 6/1992 | Nogami et al. . | |
| 5,231,956 | 8/1993 | Lux et al. . | |
| 5,269,265 | 12/1993 | Pretzsch et al. . | |
| 5,317,997 | 6/1994 | Tomitaku . | |
| 5,363,815 | 11/1994 | Pretzsch et al. | 123/198 E |
| 5,367,988 | 11/1994 | Collins . | |
| 5,438,965 | 8/1995 | Aronsson et al. | 123/198 E |
| 5,542,380 | 8/1996 | Chatten . | |

FOREIGN PATENT DOCUMENTS 564932 10/1944 United Kingdom .

*Primary Examiner*—Noah P. Kamen

*Attorney, Agent, or Firm*—Pearne, Gordon, McCoy & Granger LLP

[57] ABSTRACT

A device for centrifugal purification of combustion air in an internal combustion engine, especially for a motor saw, wherein the engine has an air cooling system including a fan wheel (19) provided in a helical fan housing (18). The device includes an air nozzle which defines an air passage for conducting combustion air from the fan housing to the engine. The air nozzle (10) is located adjacent to the fan wheel. The nozzle has an inlet (12) including a baffle wall (14) located close to the periphery of the fan wheel and conducting air to the inlet. The baffle wall has a part-elliptical shape as seen in the direction of air flow.

16 Claims, 1 Drawing Sheet

DEVICE FOR SEPARATION OF DUST

BACKGROUND OF THE INVENTION

The present invention relates to a device for centrifugal purification of combustion air in an internal combustion engine, especially for a motor saw, wherein the engine has an air cooling system including a fan wheel provided in a helical fan housing, and an air passage for conducting combustion air from the fan housing to the engine.

To clean dust and particles harmful to the engine from the combustion air, the combustion air inlet of the engine is usually provided with an air filter. When working in dusty environments, as is often the case with motor saws, the air filter will gradually be clogged by impurities. The air filter must, therefore, be cleaned or replaced periodically. In order to reduce the need for maintenance of the filter, it is desirable to clean the combustion air upstream of the filter.

Cleaning of the combustion air can be achieved by centrifugal cleaning. To this end, it is known in the art to utilize a fan wheel as a centrifuge for separating particles from the combustion air. Such a device is described in, for example, U.S. Pat. No. 2,825,318. It is also previously known from, for example, SE 9300179-0 and SE 9499795-2, to provide a tube nozzle conducting centrifugally cleaned combustion air from a cooling fan to a carburetor of an internal combustion engine via a filter chamber.

SUMMARY OF THE INVENTION

An object of the present invention is to provide a device for centrifugal cleaning of combustion air in an internal combustion engine in order to enable an improvement of the degree of air cleaning while maintaining a sufficient air flow to the engine.

In accordance with the present invention, an air passage is provided by an air nozzle located adjacent to the fan wheel and having an inlet comprising a baffle wall located close to the periphery of the fan wheel and conducting air to the inlet. In further accordance with the present invention, the baffle wall has a part-elliptical shape as seen in the air flow direction.

BRIEF DESCRIPTION OF THE DRAWINGS

The invention will be described in more detail in the following with reference to the accompanying drawing, in which.

DETAILED DESCRIPTION OF THE PREFERRED EMBODIMENT

Figure 1:
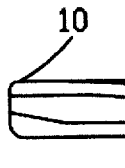
FIG. 1 is a side view of an air nozzle forming part of a device according to the present invention.
Figure 2:
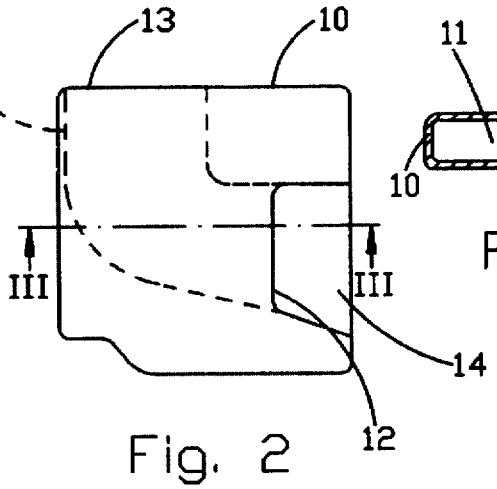
FIG. 2 is a plan view of the nozzle shown in FIG. 1.

The device shown in the drawings comprises an air nozzle generally designated 10. The nozzle 10 is preferably made of plastic and defines an air passage 11 which is curved about 90° between an inlet 12 and an outlet 13. Combustion air flows through the passage 11 to an engine (not shown). The air inlet of the engine is connected to the nozzle outlet 13. A screen or baffle wall 14 provided upstream of the inlet 12 conducts the air to the inlet 12.

Figure 3:
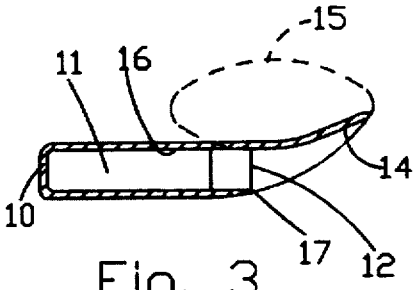
FIG. 3 a cross-sectional view of the nozzle as seen along line III—III of FIG. 2; and, FIG. 4 is a schematic view of the air nozzle according to the present invention as mounted in a fan housing.

To obtain the best possible flow characteristics, the baffle wall 14 has a partially elliptical shape, as shown in FIG. 3, wherein an ellipse 15 is shown in broken lines. The partially or semi-elliptical shape of the wall 14 provides a uniform air flow through the nozzle 10 without shedding of vortices or disturbing turbulence, which is essential for obtaining a proper air purification as well as a sufficient flow of combustion air to the engine. The ratio of the axes of the ellipse 15 is preferably about 2.4:1 which has appeared to provide an optimal result in an engine of a size commonly used in chain saws and having a fan wheel diameter of 95 millimeters. The ratio of axes of the ellipse may vary according to the size of the engine, but preferably is between about 2.0 to 3.5:1.

The partially elliptical screen wall 14 is transformed at the inlet 12 into a straight wall portion 16. The radially outward extension of the inlet 12 is defined by an edge 17, the position of which to a great extent determines the air flow through the nozzle 10. The smaller the height of the inlet 12 in the radial direction, the better the purifying performance because impurities, to a greater extent, will pass by outside the edge 17.

The inlet 12 preferably has a width to height ratio of about 3.5:1 which, for an engine of a size commonly used in chain saws and having a fan wheel diameter of 95 millimeters, has been suitable for obtaining a proper centrifugal air cleaning as well as a sufficiently large flow of air through the nozzle 10. The ratio of inlet width to height may vary according to the size of the engine, but should preferably be within the range of between about 3 to 4:1. It is also important that the disturbance of the cooling air flow to the engine caused by the nozzle 10 be as small as possible, which is also obtained by the nozzle according to the present invention.

Figure 4:
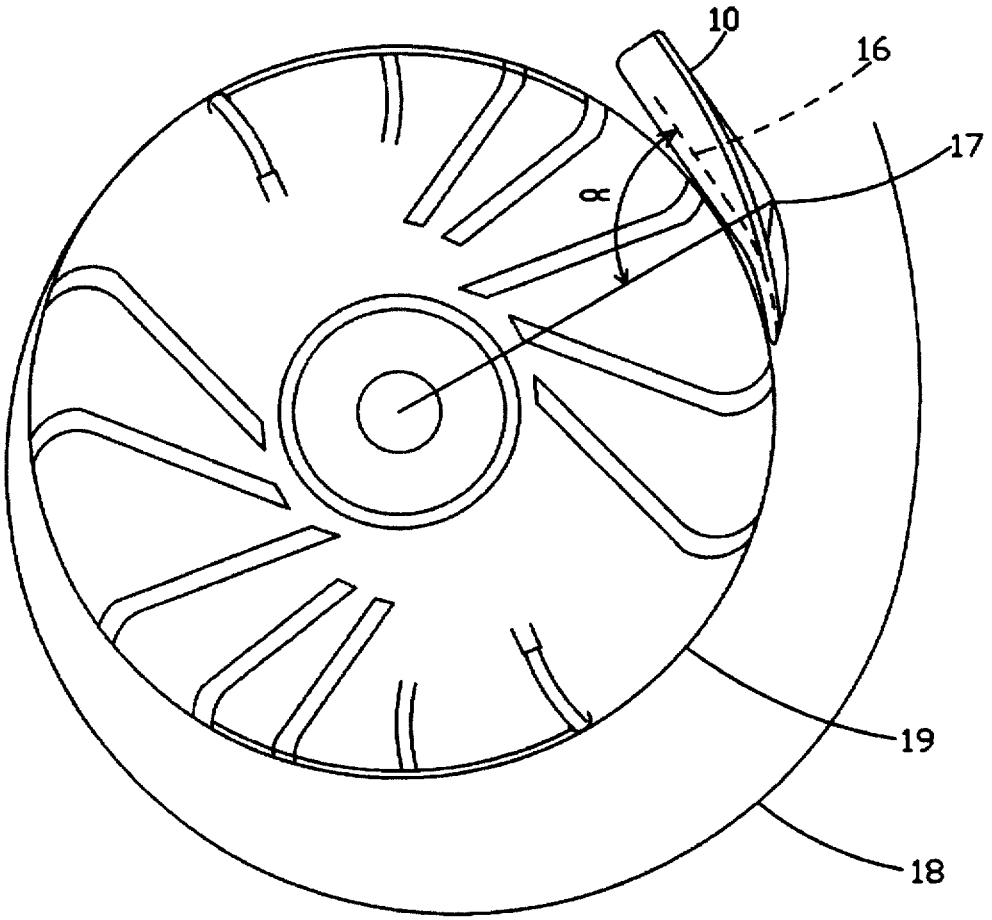

FIG. 4 illustrates the position of the nozzle 10 in a spiral or volute fan housing 18. As can be seen in FIG. 4, the nozzle 10 is preferably disposed in the fan housing adjacent a fan wheel 19. The nozzle 10 is located in the fan housing at a position in which the fan housing has a great radial width which provides for proper air cleaning. A majority of the impurities pass outside the nozzle 10 in the peripheral portion of the fan housing. The air passage 11 extends from the inlet 12, through the nozzle 10 generally tangentially to the periphery of the fan wheel 19 and subsequently curves about 90°. As such, the nozzle outlet 13 is directed generally parallel to the axis of rotation of the fan wheel 19.

The angular position of the nozzle 10 is important for achieving a favorable function. FIG. 4 shows a line extending from the center of the fan wheel 19 to the outer edge 17 of the nozzle. The inner, straight wall portion 16 of the nozzle forms an angle, designated $\alpha$ in FIG. 4. The angle $\alpha$ should preferably be between about 90°–98°. The angle $\alpha$ should, more preferably, be between about 92°–95°, which provides the best result regarding favorable centrifugal purification as well as required flow of combustion air through the nozzle 10.

The preferred embodiment of the present invention has been specifically and particularly described herein, but the scope of the invention is not limited thereto. Rather, the scope of the present invention is only to be defined by the claims appended hereto.

What is claimed is:

1. A system for centrifugal purification of combustion air, said system comprising a fan wheel, a helical fan housing surrounding said fan wheel, and an air nozzle disposed within said fan housing close to said fan wheel, said air nozzle serving as a passageway for combustion air and having an inlet (12) comprising a baffle wall (14) located close to the periphery of said fan wheel and conducting air to said inlet, said baffle wall having a semi-elliptical shape as seen in a direction of air flow, said semi-elliptical shape being defined by an ellipse having an axes ratio of between 2.0:1 to 3.5:1.

2. A system according to claim 1, wherein the axes ratio is 2.4:1.

3. A system according to claim 2, wherein the semi-elliptical baffle wall (14) is integrally connected to a straight wall portion (16) and wherein the inlet (12) has a generally rectangular cross-section, a width to height ratio of said inlet being between 3:1 to 4:1, a height of said inlet being defined by a radial distance between said straight wall portion (16) and an outer edge (17) of said air nozzle.

4. A system according to claim 3, wherein the width to height ratio of the inlet (12) is 3.5:1.

5. A system according to claim 4, wherein the straight wall portion (16) is inclined at an angle (α) of between 90° to 98° relative to a reference line between an axis of rotation of the fan wheel (19) and the outer edge (17).

6. A system according to claim 4, wherein the straight wall portion (16) is inclined at an angle (α) of between 92° to 95° relative to a reference line between an axis of rotation of the fan wheel (19) and the outer edge (17).

7. A system according to claim 6, wherein the air passage (11) of the air nozzle (10) from the inlet (12) extends generally tangentially to a periphery of the fan wheel (19) and then bends 90° such that an outlet (13) of the nozzle is directed generally parallel to the axis of rotation of the fan wheel.

8. A system according to claim 1, wherein the air passage (11) of the air nozzle (10) from the inlet (12) extends generally tangentially to a periphery of the fan wheel (19) and then bends 90° such that an outlet (13) of the nozzle is directed generally parallel to an axis of rotation of the fan wheel.

9. A system according to claim 1, wherein the semi-elliptical baffle wall (14) is integrally connected to a straight wall portion (16) and wherein the inlet (12) has a generally rectangular cross-section, a width to height ratio of said inlet being between 3:1 to 4:1, a height of said inlet being defined by a radial distance between said straight wall portion (16) and an outer edge (17) of said air nozzle.

10. A system according to claim 9, wherein the width to height ratio of the inlet (12) is 3.5:1.

11. A system according to claim 10, wherein the air passage (11) of the air nozzle (10) from the inlet (12) extends generally tangentially to a periphery of the fan wheel (19) and then bends 90° such that an outlet (13) of the nozzle is directed generally parallel to an axis of rotation of the fan wheel.

12. A system according to claim 9, wherein the straight wall portion (16) is inclined at an angle (α) of between 90° to 98° relative to a reference line between an axis of rotation of the fan wheel (19) and the outer edge (17).

13. A system according to claim 12, wherein the air passage (11) of the air nozzle (10) from the inlet (12) extends generally tangentially to a periphery of the fan wheel (19) and then bends 90° such that an outlet (13) of the nozzle is directed generally parallel to the axis of rotation of the fan wheel.

14. A system according to claim 9, wherein the straight wall portion (16) is inclined at an angle (α) of between 92° to 95° relative to a reference line between an axis of rotation of the fan wheel (19) and the outer edge (17).

15. A system according to claim 14, wherein the air passage (11) of the air nozzle (10) from the inlet (12) extends generally tangentially to a periphery of the fan wheel (19) and then bends 90° such that an outlet (13) of the nozzle is directed generally parallel to the axis of rotation of the fan wheel.

16. A system according to claim 9, wherein the air passage (11) of the air nozzle (10) from the inlet (12) extends generally tangentially to a periphery of the fan wheel (19) and then bends 90° such that an outlet (13) of the nozzle is directed generally parallel to an axis of rotation of the fan wheel.

* * * * *